US009693146B2

(12) United States Patent
Little

(10) Patent No.: US 9,693,146 B2
(45) Date of Patent: Jun. 27, 2017

(54) TRANSDUCER DIAPHRAGM

(71) Applicant: Sonos, Inc., Santa Barbara, CA (US)

(72) Inventor: Richard Warren Little, Santa Barbara, CA (US)

(73) Assignee: Sonos, Inc., Santa Barbara, CA (US)

( * ) Notice: Subject to any disclaimer, the term of this patent is extended or adjusted under 35 U.S.C. 154(b) by 14 days.

(21) Appl. No.: 14/851,977

(22) Filed: Sep. 11, 2015

(65) Prior Publication Data

US 2017/0078799 A1 Mar. 16, 2017

(51) Int. Cl.

| | |
|---|---|
| ***H04R 9/06*** | (2006.01) |
| ***H04R 9/04*** | (2006.01) |
| ***H04R 7/20*** | (2006.01) |
| ***H04R 7/12*** | (2006.01) |
| ***H04R 1/02*** | (2006.01) |
| ***H04R 31/00*** | (2006.01) |

(52) U.S. Cl.

CPC ..... *H04R 9/06* (2013.01); *H04R 1/02* (2013.01); *H04R 7/12* (2013.01); *H04R 7/20* (2013.01); *H04R 9/045* (2013.01); *H04R 31/003* (2013.01); *H04R 2231/003* (2013.01)

(58) Field of Classification Search

CPC ... H04R 1/02; H04R 7/12; H04R 7/16; H04R 7/20; H04R 9/045; H04R 9/06; H04R 31/03; H04R 2231/003

USPC ..... 181/157, 165, 167, 171, 173; 381/298, 381/423, 426, 430, 431, 432

See application file for complete search history.

(56) References Cited

U.S. PATENT DOCUMENTS

| | | | |
|---|---|---|---|
| 5,440,644 | A | 8/1995 | Farinelli et al. |
| 5,761,320 | A | 6/1998 | Farinelli et al. |
| 5,923,902 | A | 7/1999 | Inagaki |
| 6,032,202 | A | 2/2000 | Lea et al. |
| 6,256,554 | B1 | 7/2001 | DiLorenzo |
| 6,404,811 | B1 | 6/2002 | Cvetko et al. |
| 6,469,633 | B1 | 10/2002 | Wachter |
| 6,522,886 | B1 | 2/2003 | Youngs et al. |

(Continued)

FOREIGN PATENT DOCUMENTS

| | | |
|---|---|---|
| EP | 1389853 A1 | 2/2004 |
| GB | 2087688 | 5/1982 |

(Continued)

OTHER PUBLICATIONS

"AudioTron Quick Start Guide, Version 1.0", Voyetra Turtle Beach, Inc., Mar. 2001, 24 pages.

(Continued)

*Primary Examiner* — Brian Ensey

(74) *Attorney, Agent, or Firm* — McDonnell Boehnen Hulbert & Berghoff LLP

(57) ABSTRACT

A diaphragm for a loudspeaker may include a continuous primary diaphragm having an upper surface and a lower surface, where the primary diaphragm comprises a ring-shaped, flat region having an inner diameter and an outer diameter. The diaphragm may also include a reinforcing ring attached to the upper surface of the primary diaphragm, where the reinforcing ring has an inside diameter and an outside diameter, and where the reinforcing ring is attached to the upper surface of the primary diaphragm such that the inside diameter of the reinforcing ring coincides with the inner diameter of the flat region.

18 Claims, 5 Drawing Sheets

(56) References Cited

U.S. PATENT DOCUMENTS

| | | | | |
|---|---|---|---|---|
| 6,611,537 | B1 | 8/2003 | Edens et al. | |
| 6,631,410 | B1 | 10/2003 | Kowalski et al. | |
| 6,757,517 | B2 | 6/2004 | Chang | |
| 6,778,869 | B2 | 8/2004 | Champion | |
| 7,130,608 | B2 | 10/2006 | Hollstrom et al. | |
| 7,130,616 | B2 | 10/2006 | Janik | |
| 7,143,939 | B2 | 12/2006 | Henzerling | |
| 7,236,773 | B2 | 6/2007 | Thomas | |
| 7,274,798 | B2 * | 9/2007 | Ohashi | H04R 7/16 381/398 |
| 7,295,548 | B2 | 11/2007 | Blank et al. | |
| 7,483,538 | B2 | 1/2009 | McCarty et al. | |
| 7,571,014 | B1 | 8/2009 | Lambourne et al. | |
| 7,630,501 | B2 | 12/2009 | Blank et al. | |
| 7,643,894 | B2 | 1/2010 | Braithwaite et al. | |
| 7,657,910 | B1 | 2/2010 | McAulay et al. | |
| 7,853,341 | B2 | 12/2010 | McCarty et al. | |
| 7,987,294 | B2 | 7/2011 | Bryce et al. | |
| 8,014,423 | B2 | 9/2011 | Thaler et al. | |
| 8,045,952 | B2 | 10/2011 | Qureshey et al. | |
| 8,103,009 | B2 | 1/2012 | McCarty et al. | |
| 8,234,395 | B2 | 7/2012 | Millington et al. | |
| 8,483,853 | B1 | 7/2013 | Lambourne | |
| 2001/0042107 | A1 | 11/2001 | Palm | |
| 2002/0022453 | A1 | 2/2002 | Balog et al. | |
| 2002/0026442 | A1 | 2/2002 | Lipscomb et al. | |
| 2002/0124097 | A1 | 9/2002 | Isely et al. | |
| 2003/0157951 | A1 | 8/2003 | Hasty | |
| 2004/0024478 | A1 | 2/2004 | Hans et al. | |
| 2007/0071276 | A1 | 3/2007 | Kudo | |
| 2007/0142944 | A1 | 6/2007 | Goldberg et al. | |

FOREIGN PATENT DOCUMENTS

| | | | |
|---|---|---|---|
| JP | 2006222792 | | 8/2006 |
| WO | 0153994 | | 7/2001 |
| WO | 03093950 | A2 | 11/2003 |

OTHER PUBLICATIONS

"AudioTron Reference Manual, Version 3.0", Voyetra Turtle Beach, Inc., May 2002, 70 pages.

"AudioTron Setup Guide, Version 3.0", Voyetra Turtle Beach, Inc., May 2002, 38 pages.

Bluetooth. "Specification of the Bluetooth System: The ad hoc SCATTERNET for affordable and highly functional wireless connectivity," Core, Version 1.0 A, Jul. 26, 1999, 1068 pages.

Bluetooth. "Specification of the Bluetooth System: Wireless connections made easy," Core, Version 1.0 B, Dec. 1, 1999, 1076 pages.

Dell, Inc. "Dell Digital Audio Receiver: Reference Guide," Jun. 2000, 70 pages.

Dell, Inc. "Start Here," Jun. 2000, 2 pages.

Jo et al., "Synchronized One-to-many Media Streaming with Adaptive Playout Control," Proceedings of SPIE, 2002, pp. 71-82, vol. 4861.

Jones, Stephen, "Dell Digital Audio Receiver: Digital upgrade for your analog stereo" Analog Stereo Jun. 24, 2000 retrieved Jun. 18, 2014, 2 pages.

"Denon 2003-2004 Product Catalog," Denon, 2003-2004, 44 pages.

Louderback, Jim, "Affordable Audio Receiver Furnishes Homes With MP3," TechTV Vault. Jun. 28, 2000 retrieved Jul. 10, 2014, 2 pages.

Palm, Inc., "Handbook for the Palm VII Handheld," May 2000, 311 pages.

Presentations at WinHEC 2000, May 2000, 138 pages.

UPnP; "Universal Plug and Play Device Architecture," Jun. 8, 2000; version 1.0; Microsoft Corporation; pp. 1-54.

International Searching Authority, International Search Report and Written Opinion mailed on Dec. 20, 2016, issued in connection with International Application No. PCT/US2016/050993, filed on Sep. 9, 2016, 23 pages.

U.S. Appl. No. 60/490,768, filed Jul. 28, 2003, entitled "Method for synchronizing audio playback between multiple networked devices," 13 pages.

U.S. Appl. No. 60/825,407, filed Sep. 12, 2003, entitled "Controlling and manipulating groupings in a multi-zone music or media system," 82 pages.

Yamaha DME 64 Owner's Manual; copyright 2004, 80 pages.

Yamaha DME Designer 3.5 setup manual guide; copyright 2004, 16 pages.

Yamaha DME Designer 3.5 User Manual; Copyright 2004, 507 pages.

* cited by examiner

TRANSDUCER DIAPHRAGM

FIELD OF THE DISCLOSURE

The disclosure is related to consumer goods and, more particularly, to methods, systems, products, features, services, and other elements directed to media playback or some aspect thereof.

BACKGROUND

A loudspeaker in the context of the present application is an electroacoustic transducer that produces sound in response to an electrical audio signal input. Originally, non-electrical loudspeakers were developed as accessories to telephone systems. Today, electronic amplification for applications such as audible communication and enjoyment of music has made loudspeakers ubiquitous.

A common form of loudspeaker uses a diaphragm (such as, for example, a paper cone) supporting a voice coil electromagnet acting on a permanent magnet. Based on the application of the loudspeaker, different parameters may be selected for the design of the loudspeaker. For instance, the frequency response of sound produced by a loudspeaker may depend on the shape, size, and rigidity of the diaphragm, and efficiency of the voice coil electromagnet, among other factors. Accordingly, the diaphragm and voice coil electromagnet may be selected based on a desired frequency response of the loudspeaker. In some cases, for improved reproduction of sound covering a wide frequency range, multiple loudspeakers may be used collectively, each configured to optimally reproduce different frequency subranges within the wide frequency range.

As applications of loudspeakers continue to broaden, different loudspeakers designed for particular applications continue to be developed.

BRIEF DESCRIPTION OF THE DRAWINGS

Features, aspects, and advantages of the presently disclosed technology may be better understood with regard to the following description, appended claims, and accompanying drawings where:

Figures 1A, 1B, 1C:
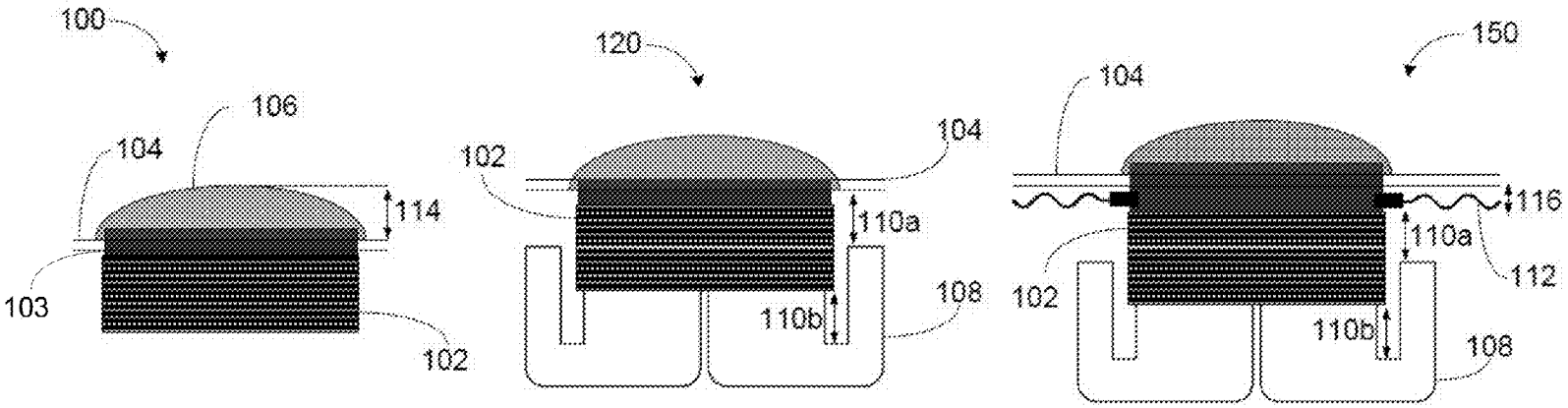
FIGS. 1A-1C show examples of conventional configurations of a loudspeaker.

The drawings are for the purpose of illustrating example embodiments and are not necessarily to scale. It is understood that the inventions are not limited to the arrangements and instrumentalities shown in the drawings.

DETAILED DESCRIPTION

I. Overview

Examples described herein involve configurations of a diaphragm for a loudspeaker that may allow for flexibility in the design of the loudspeaker. For example, some configurations of the diaphragm may allow it to remain relatively shallow while both providing a desired frequency response for the loudspeaker and resisting stresses associated with its operation. The reduced height of the diaphragm may translate to reduced height for the loudspeaker, which may allow the loudspeaker to be installed in shallow compartments where conventional non-shallow speakers may not otherwise fit.

In one example, a configuration of a diaphragm for a loudspeaker may involve a continuous diaphragm extending across a frame of the loudspeaker and covering a voice coil of an electromagnet transducer of the loudspeaker. In other words, the voice coil is covered by the diaphragm, rather than by a dust cap, as may be the case in conventional loudspeaker configurations. This may allow the loudspeaker to have a reduced height, since dust caps for covering voice coils in a loudspeaker may add height to the loudspeaker transducer, and thus the overall loudspeaker.

The diaphragm of the loudspeaker may be a uniformly thin, continuous material, and may be attached directly to the voice coil on its bottom surface. The diaphragm may further have a geometry that, in conjunction with its mass and material characteristics, provide a desired sound output level and frequency response for the loudspeaker. However, the diaphragm may be subject to relatively high stress at the connection point with the voice coil. Therefore, it may be desirable in some cases to strengthen the diaphragm in such a way that does not have an undue impact its acoustic properties.

For example, a reinforcing ring may be attached to the top surface of the diaphragm, in a flat region adjacent to the connection point with the voice coil. In this way, the thickness and therefore the strength of the diaphragm may be increased in the localized region where stresses are highest, while the geometry of the remainder of the diaphragm is unchanged.

As indicated above, the examples involve a diaphragm for a loudspeaker. In one aspect, the diaphragm includes a continuous primary diaphragm having an upper surface and a lower surface, where the primary diaphragm includes a ring-shaped, flat region having an inner diameter and an outer diameter, and a reinforcing ring attached to the upper surface of the primary diaphragm, where the reinforcing ring has an inside diameter and an outside diameter, and where the reinforcing ring is attached to the upper surface of the primary diaphragm such that the inside diameter of the reinforcing ring coincides with the inner diameter of the flat region.

In another aspect, a loudspeaker is provided. The loudspeaker includes a frame, a voice coil suspended at least partially within a gap of a magnetic structure, where the magnetic structure is attached to the frame, a diaphragm including (i) a continuous primary diaphragm having an upper surface and a lower surface, where the primary diaphragm includes a ring-shaped, flat region having an inner diameter and an outer diameter, wherein the voice coil is attached to the lower surface of the primary diaphragm, and (ii) a reinforcing ring attached to the upper surface of the primary diaphragm, where the reinforcing ring has an inside diameter and an outside diameter, and where the reinforcing ring is attached to the upper surface of the primary diaphragm such that the inside diameter of the reinforcing ring coincides with the inner diameter of the flat region, a first suspension element attached circumferentially to an outer edge of the primary diaphragm, where the first suspension element is further attached to the frame, and a second suspension element attached circumferentially to the lower surface of the primary diaphragm, where the second suspension element is further attached to the frame.

In yet another aspect, a method of assembling a diaphragm for a loudspeaker is provided. The method includes forming, from a first material having a uniform thickness, a continuous primary diaphragm having an upper surface and a lower surface, where forming the primary diaphragm comprises forming a flat region having an inner diameter and an outer diameter, forming, from a second material, a reinforcing ring having an inside diameter and an outside diameter, and attaching the reinforcing ring to the upper surface of the primary diaphragm such that the inside diameter of the reinforcing ring coincides with the inner diameter of the flat region.

It will be understood by one of ordinary skill in the art that this disclosure includes numerous other embodiments. It will be understood by one of ordinary skill in the art that this disclosure includes numerous other examples. While some examples described herein may refer to functions performed by given actors such as "users" and/or other entities, it should be understood that this description is for purposes of explanation only. The claims should not be interpreted to require action by any such example actor unless explicitly required by the language of the claims themselves.

While some examples described herein may refer to functions performed by given actors such as "users" and/or other entities, it should be understood that this is for purposes of explanation only. The claims should not be interpreted to require action by any such example actor unless explicitly required by the language of the claims themselves.

II. Examples of Conventional Loudspeaker Configurations

FIG. 1A shows an example of a conventional loudspeaker configuration 100 including a voice coil 102 and diaphragm 104 attached to the voice coil 120 via a coil coupler 103. As shown, the voice coil 102 may protrude the diaphragm 104, and accordingly, a dust cap 106 may be provided to cover the voice coil 102. In this case, the dust cap 106 may add a height 114 to the height of the loudspeaker.

FIG. 1B shows another example of a conventional loudspeaker configuration 120 having the voice coil 102 and diaphragm 104 as discussed above in connection to FIG. 1A. In this case, the voice coil 102 may be suspended within a gap of a magnetic structure 108, and may be configured to move along an internal portion of the magnetic structure 108 in response to an electric signal to cause the diaphragm to generate sound. As shown, a distance 110*b* may be provided between the voice coil 102 and a bottom of the gap, and a distance 110*a* may be provided between a top of the outer portion of the magnetic structure 108 and a bottom surface of the diaphragm to provide clearance for the voice coil 102 to move in response to the electric signal. In one example, this clearance may be referred to as an excursion clearance. In some cases, the distance 110*a* and the distance 110*b* may be substantially the same.

In some configurations, a loudspeaker may involve a suspension element, sometimes referred to as a "spider," attached circumferentially between the frame and the voice coil. The spider may make up part of a suspension system configured to keep the voice coil centered in the magnetic gap of the magnetic structure, and to provide a restoring force to return the diaphragm to a neutral position after movements of the diaphragm responsive to vibrations of the voice coil. In such a configuration, the voice coil or the coil coupler may have a required minimum height to provide sufficient clearance for movement of the spider attached to the voice coil or coil coupler during operation of the loudspeaker.

FIG. 1C shows an example of a conventional loudspeaker configuration 130 having the voice coil 102, the diaphragm 104, and magnetic structure 108 as discussed above in connection to FIGS. 1A and/or 1B. In this case, a spider 112 is attached to the coil coupler 103 as suggested above. As shown, an additional height 116 on the coil coupler 103 is provided to accommodate the attachment of the spider 112 while providing the same excursion clearance of distance 110*a*.

III. Example Diaphragms for a Loudspeaker

As discussed above, embodiments described herein may involve configurations of a diaphragm for a loudspeaker and the assembly thereof. Method 300 in FIG. 3 may include one or more operations, functions, or actions as illustrated by one or more of blocks 302-306. Although the blocks are illustrated in sequential order, these blocks may also be performed in parallel, and/or in a different order than those described herein. Also, the various blocks may be combined into fewer blocks, divided into additional blocks, and/or removed based upon the desired implementation.

In addition, for the method 300 and other processes and methods disclosed herein, the flowchart shows functionality and operation of one possible implementation of present embodiments. In this regard, each block may represent a module, a segment, or a portion of program code, which includes one or more instructions executable by one or more processors for implementing logical functions or steps in the process. For example, a processor may execute the instructions to cause one or more pieces of machinery to carry out the diaphragm assembly.

The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device. In addition, for the method 300 and other processes and methods disclosed herein, each block in FIG. 3 may represent circuitry and/or machinery that is wired or arranged to perform the specific functions in the process.

a. Example Diaphragm Configurations

Figure 2A:
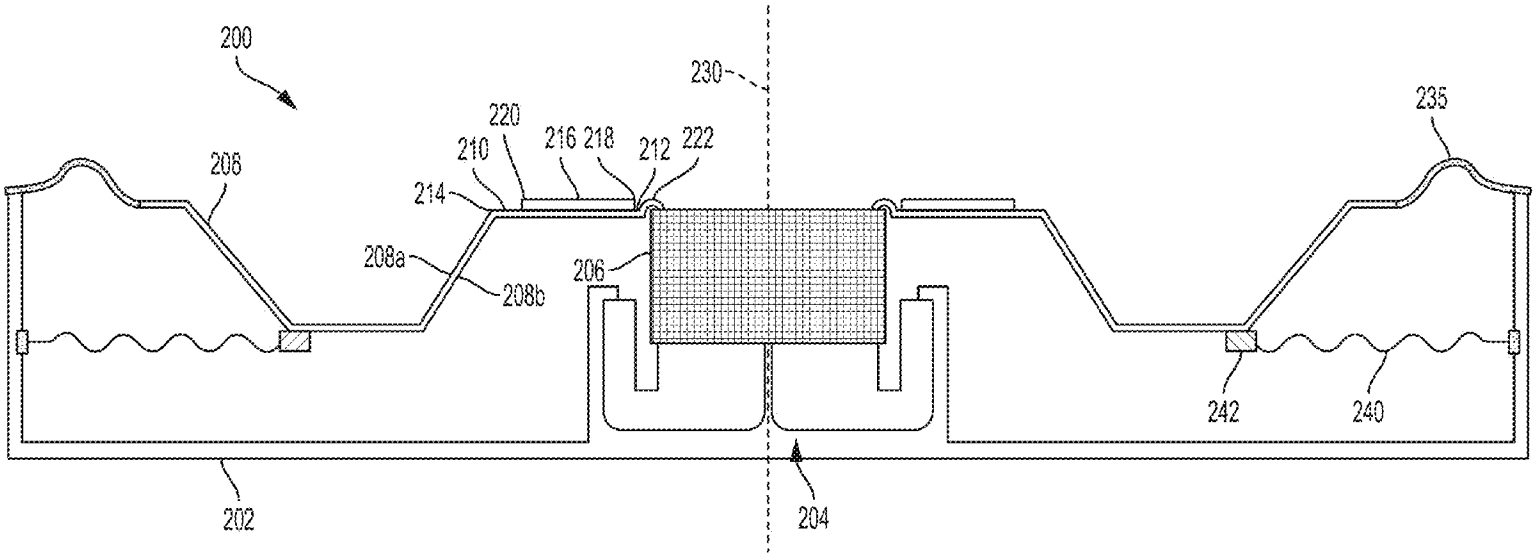
FIGS. 2A-2C show an example configuration of a diaphragm for a loudspeaker, according to an example embodiment.
Figure 2B:
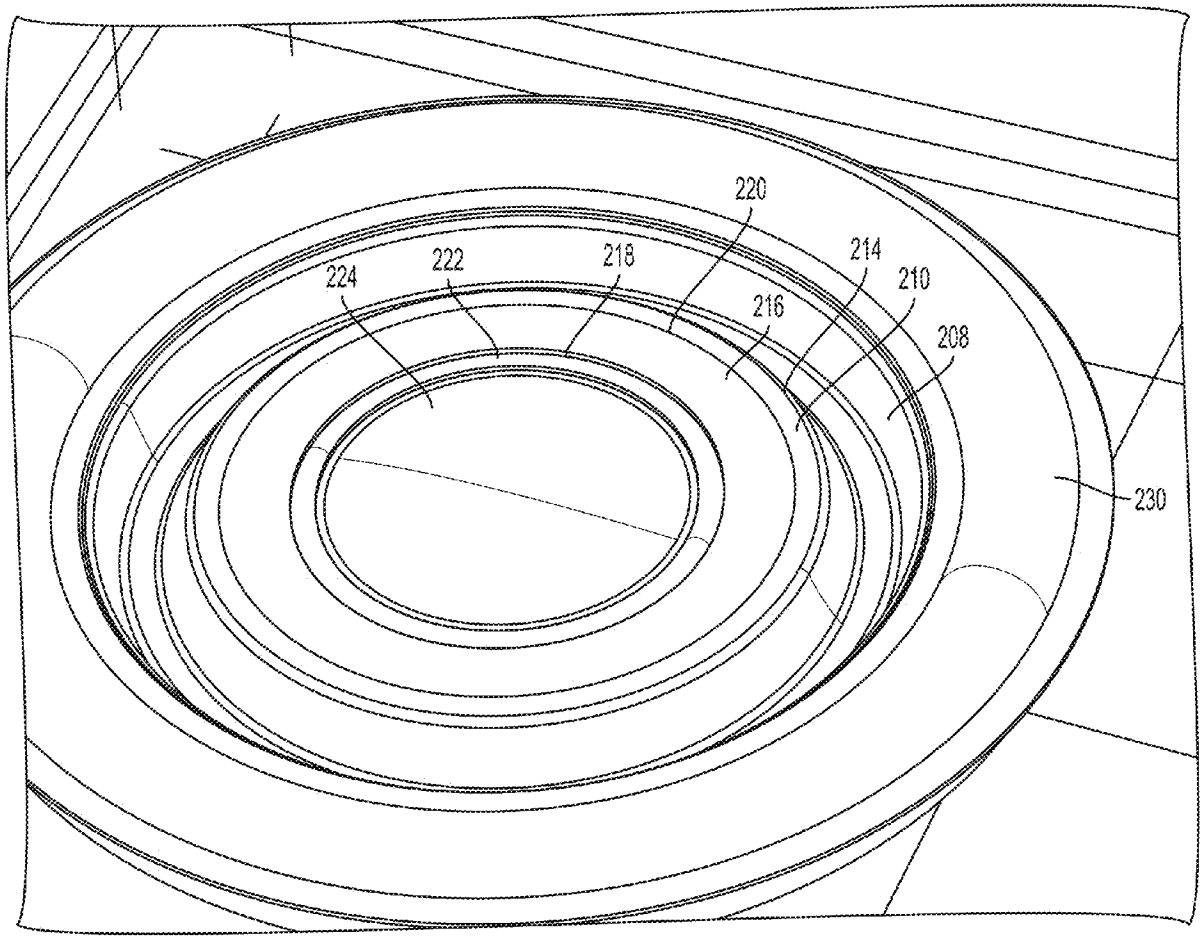
Figure 2C:
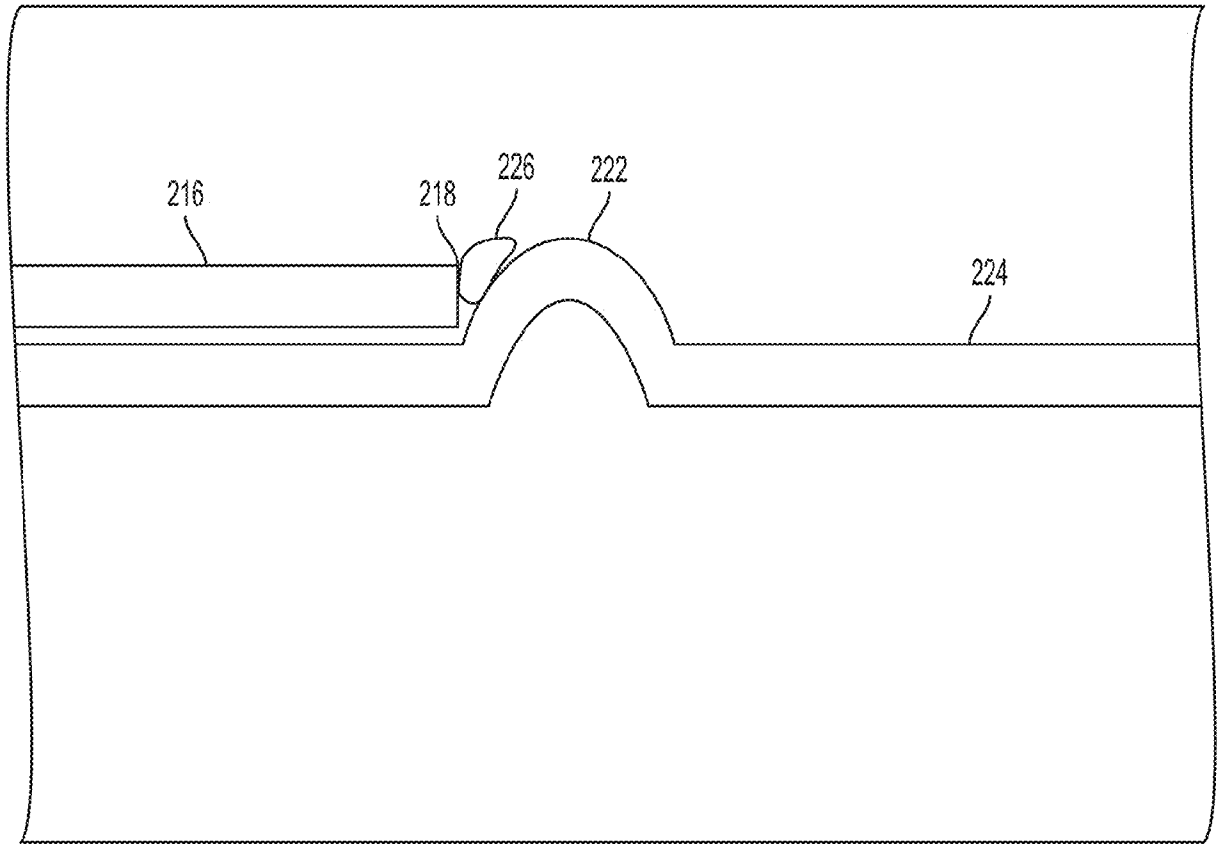

FIGS. 2A-2C show an example of a diaphragm for a loudspeaker according to an embodiment. In particular, FIG. 2A shows an example loudspeaker 200 having some components similar to those shown in FIG. 1A-1C. For example, the loudspeaker 200 includes components that are generally symmetric about a center axis 230, including a frame 202 and a magnetic structure 204 attached to the frame 202. A voice coil 206 may be suspended at least partially with a gap of the magnetic structure 204, and may move along an internal portion of the magnetic structure 204 in response to an electrical signal. The movement of the voice coil 206 may cause a corresponding movement of the diaphragm 208, generating sound.

In an example embodiment, the diaphragm 207 may include a continuous primary diaphragm 208 covering the voice coil 206, as shown in FIG. 2A. Unlike some of the conventional loudspeaker configurations as discussed above, the loudspeaker 200 may not include a dust cap. This may contribute to the loudspeaker 200 having a reduced overall height. Further, conventional loudspeakers configured with dust caps may require additional component costs and manufacturing time to install the dust cap. As such, a loudspeaker with a continuous diaphragm covering the voice coil may further involve reduced costs and manufacturing time.

However, the specific configuration of the diaphragm may affect the sound output level and frequency response of the loudspeaker 200. For this reason, as well as other possible considerations, it may be desirable in some situations for the primary diaphragm to be discontinuous, having a concentric aperture at its center. In this case, the voice coil may be covered by a dust cap, as in the conventional loudspeaker designs shown in FIGS. 1A-1C. The voice coil may be attached to the bottom surface of the primary diaphragm, at or near the perimeter of the aperture.

Returning to the example shown in FIGS. 2A-2B, the primary diaphragm 208 has an upper surface 208*a*, facing outwardly from the loudspeaker 200, and a lower surface 208*b*. In some embodiments, the primary diaphragm 208 may be formed from a continuous piece of aluminum with a uniform thickness of, for instance, 0.30 millimeters. Other thicknesses and other materials, such as paper, plastic, or a composite material, are also possible, and may be selected based on their effect on the sound output level and frequency response of the loudspeaker 200.

Similarly, the shape of the primary diaphragm 208 may also affect the loudspeaker's acoustic performance, as well as its overall height. In some cases, the primary diaphragm 208 may be shaped to include a flat region 210, as shown in FIG. 2A. Because the primary diaphragm 208 is circular in shape, as shown in FIG. 2B, the flat region 210 is ring-shaped, having an inner diameter 212 and an outer diameter 214. In alternative embodiments, the ring-shaped flat region 210 may be concave, convex, or other shapes, rather than flat. The design of this region of the primary diaphragm 208 may be based on a desired frequency response for the loudspeaker 200 or manufacturing considerations, among other possibilities.

In some cases, the primary diaphragm 208 may include a groove 222 adjacent to the inner diameter 212 of the flat region 210. The groove 222 may be formed by an indentation on the lower surface 208*b* of the primary diaphragm 208 and a corresponding protrusion on the upper surface 208*a*, which may be seen most clearly in FIG. 2C. The groove 222 may surround a flat, continuous area 224 in the center of the primary diaphragm 208 that is positioned above the voice coil 206. Alternatively, in examples where the primary diaphragm 208 includes a center aperture, the groove 222 may be located at or near the perimeter of the aperture.

Further, the voice coil 206 (not shown in FIG. 2C) may be attached to the bottom surface 208*b* of the primary diaphragm 208 at the groove, as can be seen in FIG. 1A. For example, a top edge of the voice coil 206 may fit into the groove 222, and may be attached to the primary diaphragm 208 at this location using an adhesive. The voice coil 206 may be attached to the lower surface 208*b* of the primary diaphragm 208 in other ways as well. For instance, in an alternative embodiment, the groove 222 may include an indentation/protrusion in the opposite arrangement, and the voice coil 206 may be attached adjacent to the groove 222.

Attaching the voice coil 206 directly to the primary diaphragm 208 may eliminate the need for a coupling component to attach the two, such as the coil coupler 103 shown in FIG. 1A-1C, which is used in some conventional loudspeaker configurations. In this way, the overall height of the loudspeaker 200 may be reduced.

In some cases, it may be advantageous to keep the primary diaphragm 208 uniformly thin, such that it may be formed from a single sheet of uniformly thin material. However, the primary diaphragm 208 in the configurations discussed above may experience relatively high stresses at the location where the voice coil 206 is attached. Increasing the overall thickness of the primary diaphragm 208 may help it to withstand the stresses at the connection point of the voice coil 206, however it may also make the primary diaphragm 208 more difficult to form into the desired geometry. Moreover, the thickness of the primary diaphragm 208 may have an effect on its overall mass, and therefore the acoustic performance of the loudspeaker 200.

Therefore, in some embodiments, the thickness of the overall diaphragm 207 may be increased only in the localized area where the stresses are the highest. For example, the primary diaphragm 207 may be formed from a continuous piece material having a variable thickness. As another example, a reinforcing ring 216 may be attached to the upper surface 208*a* of the primary diaphragm 208. The reinforcing ring 216 may have an inside diameter 218 and an outside diameter 220, and it may be attached to the flat region 210 such that the inside diameter 218 of the reinforcing ring 216 coincides with the inner diameter 212 of the flat region 210.

The reinforcing ring 216 may be attached to the flat region 210 of the primary diaphragm 208 using, for instance, an adhesive. The reinforcing ring 216 may be the same material and thickness as the primary diaphragm 208 or it may be different in either respect. As an example, the reinforcing ring 216 may be composed of aluminum and may also have a thickness of 0.30 millimeters, such that the combined thickness of the diaphragm 207 where the reinforcing ring is attached is twice the uniform thickness of the primary diaphragm 208. In this way, the diaphragm 207 may be reinforced in the area of highest stress without increasing its mass over its entire area. Other examples are also possible, including a reinforcing ring with a variable thickness. For instance, the reinforcing ring may be thicker at its inside diameter where stresses on the primary diaphragm are highest, and then taper to a thinner at its outside diameter.

Further, in an embodiment where the ring-shaped region is not flat, but rather concave, convex, or some other shape, the reinforcing ring 216 may have a similar, matching geometry. In this way, the primary diaphragm 208 and the reinforcing ring 216 may have abutting, parallel surfaces that may be attached with an adhesive, as discussed above.

Because the inside diameter 218 of the reinforcing ring 216 coincides with the inner diameter 212 of the flat region 210, the reinforcing ring 216 may also be adjacent to the groove 222. However, the groove 222 may have a curvature, which can be seen in FIG. 2C, such that the reinforcing ring 216 and the groove 222 diverge from each other. Therefore, the diaphragm 207 may include a bead of adhesive 226 joining the inside diameter of the reinforcing ring 216 with the groove 222, as shown in FIG. 2C. As a result, the reinforcing ring 216 may be bonded to the primary diaphragm 208 along an additional surface, increasing the reinforcing ring's ability to help bear the stresses applied to the primary diaphragm 208.

The bead of adhesive 226 may be a glue, epoxy, or any other compound suitable for attaching the reinforcing ring 216 to the primary diaphragm 208. It may take the approximate form shown in FIG. 2C, or it may substantially fill the entire space between the inside diameter 218 of the reinforcing ring 216 and the groove 222. For example, the bead of adhesive may be continuous with the adhesive used to attach the reinforcing ring 216 to the flat region 210. Other examples are also possible.

The width of the reinforcing ring 216, i.e., the distance between the inside diameter 218 and the outside diameter 220, may depend on the thickness of the reinforcing ring 216 and the acoustic effect that the added mass will have on the loudspeaker 200. In some examples, such as the examples shown in FIGS. 2A-2B, the reinforcing ring 216 may not extend all the way to the outer diameter of the flat region 210. Alternatively, the outside diameter 220 of the reinforcing ring 216 may coincide with the outer diameter 214 of the flat region 210.

Additional arrangements of the components discussed herein are also possible. For example, an alternative embodiment may involve the reinforcing ring 216 being attached to the lower surface 208*b* of the primary diaphragm 208. In this arrangement, the voice coil 206 may be attached directly to the reinforcing ring 216, rather than the primary diaphragm 208. Additionally or alternatively, the indentation and protrusion of the groove 222 may have the opposite configuration, such that the groove 222 protrudes form the bottom surface 208*b* of the primary diaphragm 208. In this arrangement, the reinforcing ring 216 may be adjacent to and adhered to the groove 222 on the bottom surface 208*b*. Other examples are also possible.

The loudspeaker 200 may also include a suspension system configured to keep the voice coil 206 centered in the magnetic gap of the magnetic structure 204, and to provide a restoring force to return the diaphragm 207 to a neutral position after movements of the diaphragm 207 responsive to vibrations of the voice coil 206. The suspension system may include a first suspension element 235 attached circumferentially to an outer edge of the primary diaphragm 208. The first suspension element 235, also known as a "surround," is further attached to the frame 202, and may be made of rubber, polyester foam, or corrugated, resin coated fabric, for example. Other materials may also be possible. The sound output level and frequency response of the loudspeaker 200 may be dependent on the material and dimensions of the surround 235.

The suspension system may also include a second suspension element 240 attached circumferentially to the lower surface 208*b* of the primary diaphragm 208 by, for example, a coupler 242. The coupler 242 may include an adhesive substance configured to bind the second suspension element 240, also known as a "spider," to the primary diaphragm 208. The spider 240 may be further attached to the frame 202. The spider 240 may be made of a treated fabric material, flexible rubber, or flexible elastomer, for example. Other materials may also be possible. The sound output level and frequency response of the loudspeaker 200 may be dependent on the material and dimensions of the spider 240. In one example, the spider 240 may have a concentrically corrugated structure.

Unlike many conventional loudspeaker configurations, such as those shown in FIGS. 1A-1C, a configuration in which the spider 240 is attached between the frame 202 and the diaphragm 207 rather than between the frame and the voice coil or coil coupler may eliminate the need for additional height on the voice coil or coil coupler. It may also reduce the excursion clearance required for the voice coil, thereby allowing the loudspeaker to have a reduced height.

b. Example Implementations for Assembly of a Diaphragm

Figure 3:
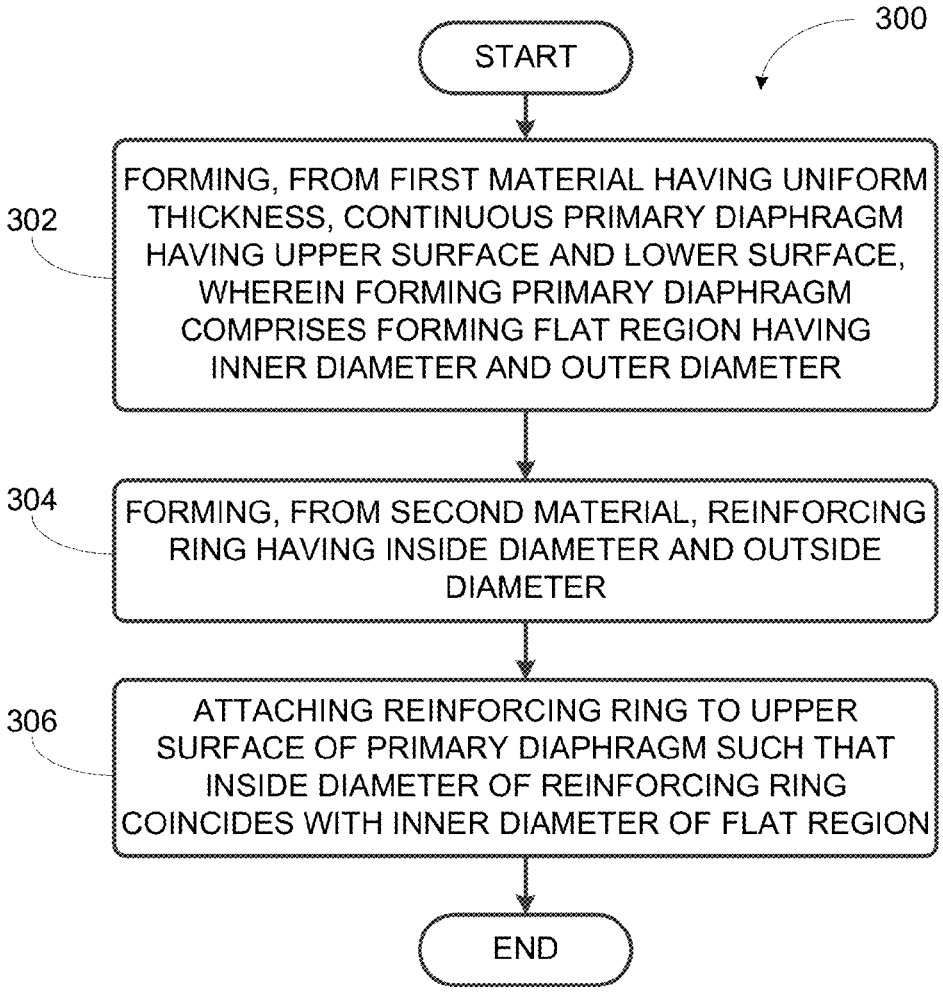
FIG. 3 shows an example flow diagram for assembly of a diaphragm for a loudspeaker, according to an example embodiment.

The flow diagram 300 shown in FIG. 3 illustrates an example implementation for assembly of a diaphragm for a loudspeaker, such as the diaphragm 207 shown in the loudspeaker 200 of FIGS. 2A-2C.

At block 302 of the method 300, assembly of the diaphragm 207 may involve forming, from a first material having a uniform thickness, a continuous primary diaphragm 208 having an upper surface 208*a* and a lower surface 208*b*. The first material may be, for example, aluminum having a thickness of 0.30 millimeters. Moreover, forming the primary diaphragm 208 may include forming a flat region 210 having an inner diameter 212 and an outer diameter 214, and in some cases, forming a groove 222 adjacent to the inner diameter 212 of the flat region 210.

At block 304 of the method 300, assembly of the diaphragm 207 may involve forming, from a second material, a reinforcing ring 216 having an inside diameter 218 and an outside diameter 220. The reinforcing ring 216 may be formed from the same or a different material than the primary diaphragm 208, and may have a constant or variable thickness, as discussed above.

At block 306 of the method 300, the assembly may involve attaching the reinforcing ring 216 to the upper surface 208*a* of the primary diaphragm 208 such that the inside diameter 218 of the reinforcing ring 216 coincides with the inner diameter 212 of the flat region 210. For example, the reinforcing ring 216 may be attached with an adhesive to the flat region 210 of the primary diaphragm 208. As noted above, this pay provide the diaphragm 207 with a greater thickness in the location that it experiences the most stress during operation of the loudspeaker 200.

Further, the attachment of the reinforcing ring 216 to the primary diaphragm 208 as discussed may place the reinforcing ring 216 substantially adjacent to the groove 222, as shown in FIG. 2C. Accordingly, assembly of the diaphragm 207 may further involve applying a bead of adhesive 226 to the diaphragm 207 such that the bead of adhesive 226 joins the inside diameter 218 of the reinforcing ring 216 with the groove 222.

Additional components of the loudspeaker 200 may be attached to the diaphragm 207 as well. For instance, a voice coil 206 may be attached to the lower surface 208*b* of the primary diaphragm 208. The voice coil 206 may be, for example, attached at the groove 222 using an adhesive as discussed above. A suspension system, including a surround and a spider, may also be attached to the diaphragm 207, as previously discussed.

IV. Conclusion

The description above discloses, among other things, various example systems, methods, apparatus, and articles of manufacture including, among other components, firmware and/or software executed on hardware. It is understood that such examples are merely illustrative and should not be considered as limiting. For example, it is contemplated that any or all of the firmware, hardware, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

As indicated above, the examples involve a diaphragm for a loudspeaker. In one aspect, a diaphragm for a loudspeaker is provided. The diaphragm includes a continuous primary diaphragm having an upper surface and a lower surface, where the primary diaphragm includes a ring-shaped, flat region having an inner diameter and an outer diameter, and a reinforcing ring attached to the upper surface of the primary diaphragm, where the reinforcing ring has an inside diameter and an outside diameter, and where the reinforcing ring is attached to the upper surface of the primary diaphragm such that the inside diameter of the reinforcing ring coincides with the inner diameter of the flat region.

In another aspect, a loudspeaker is provided. The loudspeaker includes a frame, a voice coil suspended at least partially within a gap of a magnetic structure, where the magnetic structure is attached to the frame, a diaphragm including (i) a continuous primary diaphragm having an upper surface and a lower surface, where the primary diaphragm includes a ring-shaped, flat region having an inner diameter and an outer diameter, wherein the voice coil is attached to the lower surface of the primary diaphragm, and (ii) a reinforcing ring attached to the upper surface of the primary diaphragm, where the reinforcing ring has an inside diameter and an outside diameter, and where the reinforcing ring is attached to the upper surface of the primary diaphragm such that the inside diameter of the reinforcing ring coincides with the inner diameter of the flat region, a first suspension element attached circumferentially to an outer edge of the primary diaphragm, where the first suspension element is further attached to the frame, and a second suspension element attached circumferentially to the lower surface of the primary diaphragm, where the second suspension element is further attached to the frame.

In yet another aspect, a method of assembling a diaphragm for a loudspeaker is provided. The method includes forming, from a first material having a uniform thickness, a continuous primary diaphragm having an upper surface and a lower surface, where forming the primary diaphragm comprises forming a flat region having an inner diameter and an outer diameter, forming, from a second material, a reinforcing ring having an inside diameter and an outside diameter, and attaching the reinforcing ring to the upper surface of the primary diaphragm such that the inside diameter of the reinforcing ring coincides with the inner diameter of the flat region.

Additionally, references herein to "embodiment" means that a particular feature, structure, or characteristic described in connection with the embodiment can be included in at least one example embodiment of an invention. The appearances of this phrase in various places in the specification are not necessarily all referring to the same embodiment, nor are separate or alternative embodiments mutually exclusive of other embodiments. As such, the embodiments described herein, explicitly and implicitly understood by one skilled in the art, can be combined with other embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

I claim:

1. A diaphragm for a loudspeaker, the diaphragm comprising:

a continuous primary diaphragm having an upper surface and a lower surface, wherein the primary diaphragm comprises a ring-shaped, flat region having an inner diameter and an outer diameter; and a reinforcing ring attached to the upper surface of the primary diaphragm, wherein the reinforcing ring has an inside diameter and an outside diameter, and wherein the reinforcing ring is attached to the upper surface of the primary diaphragm such that the inside diameter of the reinforcing ring coincides with the inner diameter of the flat region; and, wherein the primary diaphragm comprises a groove adjacent to the inner diameter of the flat region.

2. The diaphragm of claim 1, wherein the primary diaphragm has a uniform thickness.

3. The diaphragm of claim 2, wherein the reinforcing ring comprises a thickness equal to the uniform thickness of the primary diaphragm, such that a combined thickness of the diaphragm where the reinforcing ring is attached is twice the uniform thickness.

4. The diaphragm of claim 1, wherein the outside diameter of the reinforcing ring coincides with the outer diameter of the flat region.

5. The diaphragm of claim 1, wherein the groove comprises an indentation on the lower surface of the primary diaphragm and a corresponding protrusion on the upper surface of the primary diaphragm.

6. The diaphragm of claim 1, wherein the groove of the primary diaphragm surrounds a flat, continuous area.

7. The diaphragm of claim 1, wherein the diaphragm further comprises a bead of adhesive joining the inside diameter of the reinforcing ring with the groove.

8. A loudspeaker comprising:

a frame;

a voice coil suspended at least partially within a gap of a magnetic structure, wherein the magnetic structure is attached to the frame;

a diaphragm comprising:

a continuous primary diaphragm having an upper surface and a lower surface, wherein the primary diaphragm comprises a ring-shaped, flat region having an inner diameter and an outer diameter; and a reinforcing ring attached to the upper surface of the primary diaphragm, wherein the reinforcing ring has an inside diameter and an outside diameter, and wherein the reinforcing ring is attached to the upper surface of the primary diaphragm such that the inside diameter of the reinforcing ring coincides with the inner diameter of the flat region;

a first suspension element attached circumferentially to an outer edge of the primary diaphragm, wherein the first suspension element is further attached to the frame; and a second suspension element attached circumferentially to the lower surface of the primary diaphragm, wherein the second suspension element is further attached to the frame.

9. The loudspeaker of claim 8, wherein the primary diaphragm has a uniform thickness.

10. The loudspeaker of claim 9, wherein the reinforcing ring comprises a thickness equal to the uniform thickness of the primary diaphragm, such that a combined thickness of the diaphragm where the reinforcing ring is attached is twice the uniform thickness.

11. The loudspeaker of claim 8, wherein the outside diameter of the reinforcing ring coincides with the outer diameter of the flat region.

12. The loudspeaker of claim 8, wherein the primary diaphragm comprises a groove adjacent to the inner diameter of the flat region, and wherein the voice coil is attached to the lower surface of the primary diaphragm at the groove.

13. The loudspeaker of claim 12, wherein the groove comprises an indentation on the lower surface of the primary diaphragm and a corresponding protrusion on the upper surface of the primary diaphragm.

14. The loudspeaker of claim 12, wherein the groove of the primary diaphragm surrounds a flat, continuous area positioned above the voice coil.

15. The loudspeaker of claim 12, wherein the diaphragm further comprises a bead of adhesive joining the inside diameter of the reinforcing ring with the groove.

16. A method of assembling a diaphragm for a loudspeaker comprising:

forming, from a first material having a uniform thickness, a continuous primary diaphragm having an upper surface and a lower surface, wherein forming the primary diaphragm comprises forming a flat region having an inner diameter and an outer diameter; and forming, from a second material, a reinforcing ring having an inside diameter and an outside diameter; and attaching the reinforcing ring to the upper surface of the primary diaphragm such that the inside diameter of the reinforcing ring coincides with the inner diameter of the flat region; and, wherein forming the continuous primary diaphragm further comprises forming a groove adjacent to the inner diameter of the flat region.

17. The method of claim 16, further comprising:

applying a bead of adhesive to the diaphragm such that the bead of adhesive joins the inside diameter of the reinforcing ring with the groove.

18. The method of claim 16, further comprising:

attaching a voice coil to the lower surface of the primary diaphragm, wherein the voice coil is attached at the groove.

* * * * *